US005950287A

United States Patent [19]

Cacciatore et al.

[11] Patent Number: 5,950,287

[45] Date of Patent: Sep. 14, 1999

[54] APPARATUS FOR CONTAINING CREMATION ASHES AND DISPLAYING A PHOTOGRAPH

[76] Inventors: Vincent Cacciatore; Patrice Cacciatore, both of 73 Stanton St., Yonkers, N.Y. 10704

[21] Appl. No.: 08/938,645

[22] Filed: Sep. 26, 1997

[51] Int. Cl.[6] ..... A61G 17/00

[52] U.S. Cl. ..... 27/1; 40/655; 40/661.07; 40/725; 63/19

[58] Field of Search ..... 27/1; 40/655, 653, 40/661.07, 661, 725, 729, 1.6, 712, 721, 723, 724, 771; 63/18, 19, 1.14

[56] References Cited

U.S. PATENT DOCUMENTS

| | | | |
|---|---|---|---|
| 354,144 | 12/1886 | Inman | 63/19 |
| 1,255,870 | 2/1918 | Foster | 63/19 |
| 3,618,338 | 11/1971 | Sauer | 63/19 |
| 4,199,848 | 4/1980 | Kohnert | 27/1 |
| 4,542,631 | 9/1985 | Esser, III | 63/18 X |
| 5,158,174 | 10/1992 | Hereford | 63/1.14 X |
| 5,414,948 | 5/1995 | Kudo | 63/19 X |
| 5,522,163 | 6/1996 | Neugebauer | 40/661 X |
| 5,713,147 | 2/1998 | Johnson | 40/771 |

*Primary Examiner*—Brian K. Green
*Assistant Examiner*—William L. Miller
*Attorney, Agent, or Firm*—Goldstein & Canino

[57] ABSTRACT

An apparatus for containing cremation ashes and displaying a photograph in the same compartment. The apparatus comprises a base which has an outer ridge to contain cremation ashes. The base is of sufficient depth to accept a photograph over the deposited ashes. A cover is pivotally connected to the base and can be closed over the base in order to protect and prevent loss of the contents. The cover has a transparent base which allows the photograph and cremation ashes to be easily viewed by the user. The apparatus can take the form of a locket, a pendant or can be interlocked with other units to form a charm bracelet. The apparatus can be modified to mount on a wall or stand on a countertop.

1 Claim, 2 Drawing Sheets

APPARATUS FOR CONTAINING CREMATION ASHES AND DISPLAYING A PHOTOGRAPH

BACKGROUND OF THE INVENTION

The invention relates to an apparatus for containing cremation ashes and displaying a photograph. More particularly, the invention relates to a portable apparatus for containing cremation ashes and displaying a photograph which provides emotional support and sentimental value to a user.

Losing a loved one is a traumatic experience that different people deal with in different ways. Many people have difficulty in accepting the loss and need a way to reach back in time to provide themselves with emotional support. Photographs are commonly used in this manner, but do not always accomplish this intended purpose. Photographs provide a flash back in time, but do not provide a physical connection to the present. This has the potential to drive an individual into a deeper state of emotional distress than if he or she did not have the photograph at all. There exists a need for a piece of memorabilia which can combine a link to the past, such as a photograph, with a physical connection to the present in order to provide emotional support to those who have lost loved ones.

Other devices have attempted to deal with this dilemma but have not combined the structure and functionality of the present invention.

While these units may be suitable for the particular purpose employed, or for general use, they would not be as suitable for the purposes of the present invention as disclosed hereafter.

SUMMARY OF THE INVENTION

It is an object of the invention to produce an apparatus for containing cremation ashes and displaying a photograph.

It is a another object of the invention to produce a portable apparatus for containing cremation ashes and displaying a photograph which provides emotional support and sentimental value to a user.

It is still another object of the invention to produce an apparatus for containing cremation ashes and displaying a photograph which can be used as a locket.

It is a further object of the invention to produce an apparatus for containing cremation ashes and displaying a photograph which can be used as a pendant.

It is an still further object of the invention to produce an apparatus for containing cremation ashes and displaying a photograph which can interlock with similar units and be used as a charm bracelet.

It is an yet another object of the invention to produce an apparatus for containing cremation ashes and displaying a photograph which can mount on a wall or stand on a countertop.

It is yet a further object of the invention to produce an apparatus for containing cremation ashes and displaying a photograph which provides emotional support and sentimental value to a user.

The invention is an apparatus for containing cremation ashes and displaying a photograph in the same compartment. The invention comprises a base which has an outer ridge to contain cremation ashes. The base is of sufficient depth to accept a photograph over the deposited ashes. A cover is pivotally connected to the base and can be closed over the base in order to protect and prevent loss of the contents. The cover has a transparent base which allows the photograph and cremation ashes to be easily viewed by the user. The invention can take the form of a locket, a pendant or can be interlocked with other units to form a charm bracelet. The invention can be modified to mount on a wall or stand on a countertop.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1A:
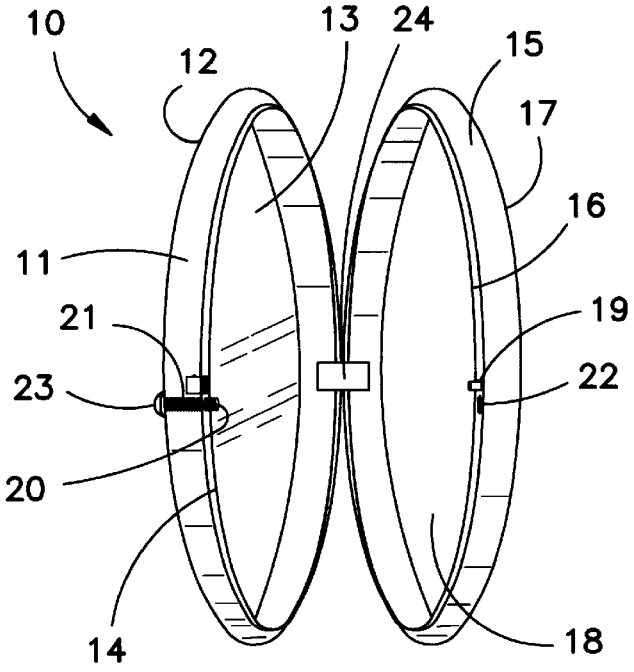
FIG. 1A is an illustration of the clasping device of the invention.
Figure 1B:
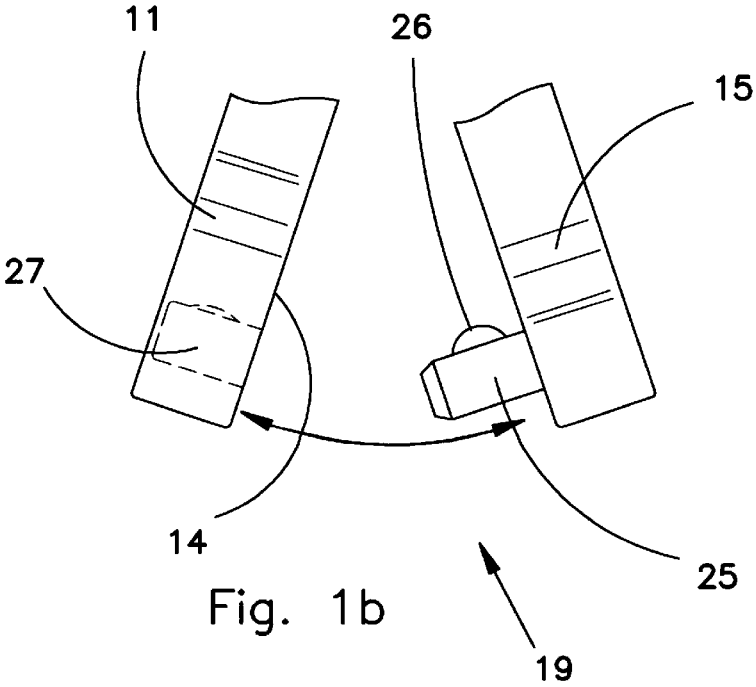
FIG. 1 is an illustration of the basic components of the invention. The illustration shows the invention in the form of a locket.

FIG. 1 illustrates an apparatus for containing cremation ashes and displaying a photograph 10 in the form of a locket. Shown is a base 11 having an exterior side 12 and an interior side 13. An outer ridge 14 on the interior side 13 of the base 11 allows the base 11 to accept and contain cremation ashes and a photograph. A cover 15 is pivotally attached to the base 11 by a hinge mechanism 24. This attachment allows the cover 15 to convert from an open position to a closed position. The cover 15 has an interior 16 and an exterior 17. In the open position, the user is able to deposit the cremation ashes into the base and place a photograph over the ashes. The cover 15 is then converted to the closed position to protect and prevent loss of the contents. The cover 15 has a transparent face 18 in order to view the cremation ashes and the photograph. The apparatus 10 has a clasping mechanism 19 to hold the cover 15 in place with the base 11. In addition, the apparatus 10 has a safety lock 20 to ensure that the apparatus 10 does not accidentally open and spill the contents. This is important in that the cremation ashes will be virtually irretrievable if they are accidentally spilled. In the preferred embodiment of the invention the base 11 has an internal threaded bore 21 extending from the exterior side of the base 12 through the external ridge 14 and through to the interior side of the base 13. The cover 15 has a second internal bore 22 extending from the interior 16 of the cover 15 to a point between the interior 16 and exterior 17 of the cover 15. When the cover 15 is in the closed position, a screw 23 extends through the first bore 21 and into the second bore 22 to provide a safety lock which ensures that the apparatus 10 remains closed.

FIG. 1A shows the preferred embodiment of the clasping mechanism 19 which engages the cover 15 and the base 11. An appendage 25 extends perpendicular from the interior of the cover 16 and a knobby extension 26 extends perpendicular from the appendage 25 and parallel to the cover 15. The outer ridge 14 of the base 11 contains an aperture 27 which is fit to receive the appendage 25 and the knobby extension 26. When snapped into place by a user, the knobby extension 26 prevents the cover 15 from easily disengaging from the base 11.

Figure 2:
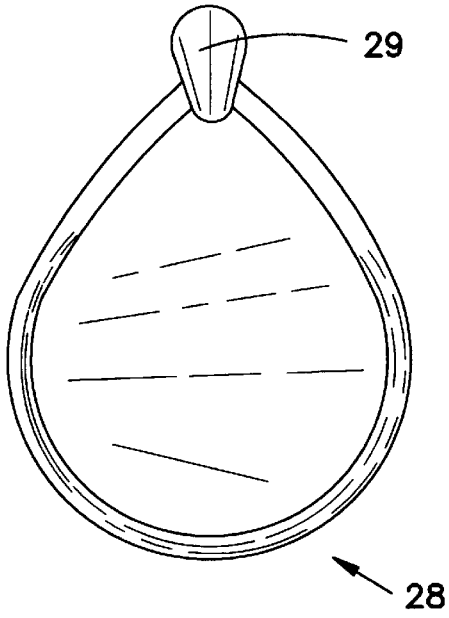
FIG. 2 is an illustration of the invention in the form of a pendant.

FIG. 2 shows the invention as in FIG. 1 in the form of a pendant 28. Illustrated is an ornamental loop 29 which can be connected to a chain, whereby the user can wear the invention around his or her neck.

Figure 3:
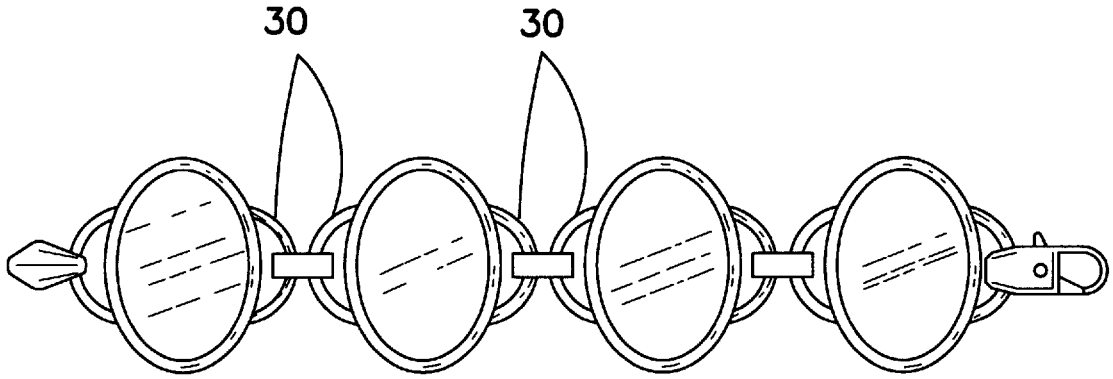
FIG. 3 is an illustration of the invention interlocked with similar units to form a charm bracelet.

FIG. 3 shows an embodiment of the invention which has ears 30 extending from the base 11 of the invention. This embodiment allows more than one apparatus to be joined together to form a charm bracelet 31. This modification allows the user to have a piece of memorabilia which can hold the cremation ashes and photograph of more than one loved one.

Figure 4:
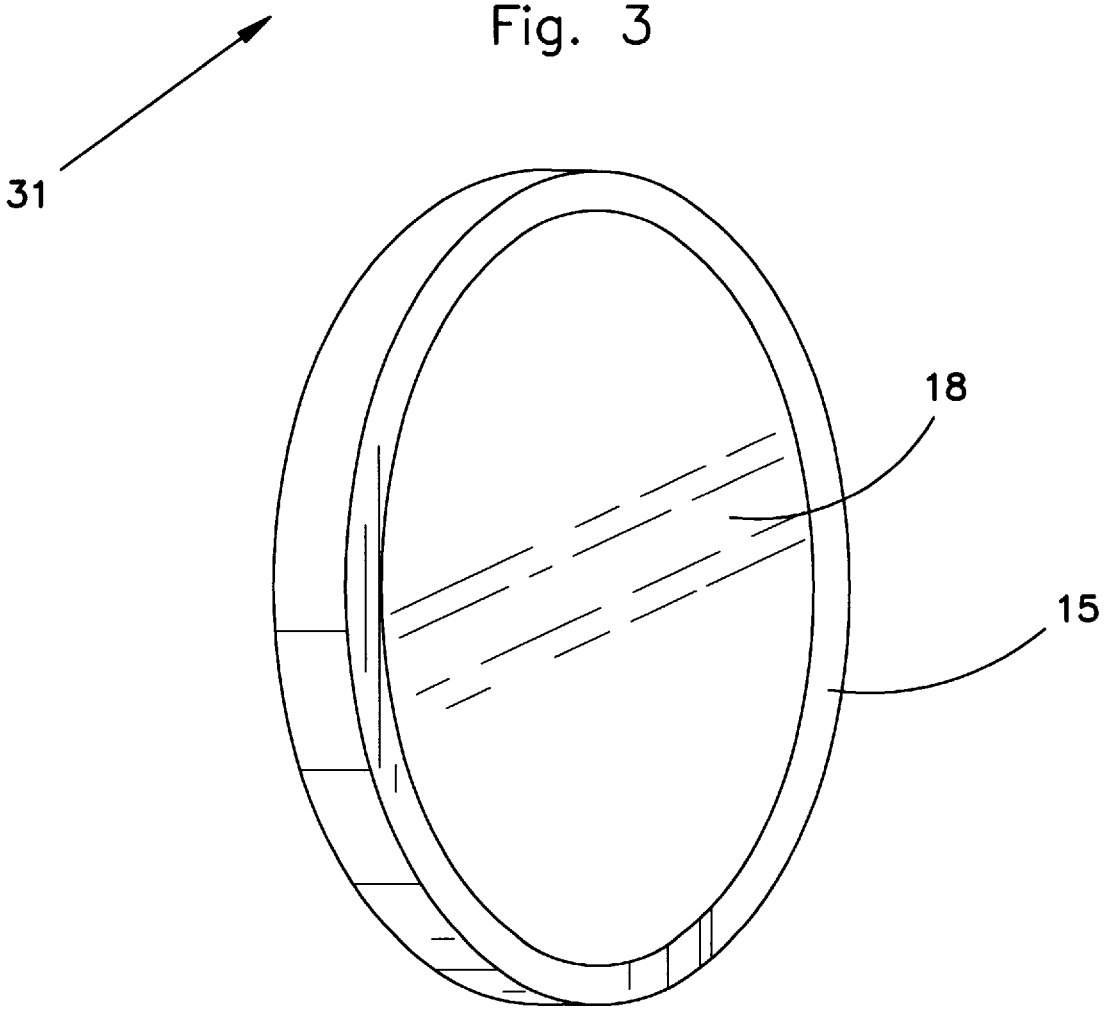
FIG. 4 is an illustration of the invention in the form of a picture frame.

FIG. 4 shows the invention in a form that can mount on a wall or stand on a countertop. Illustrated is the cover 15 with the transparent face 18.

In conclusion, herein is shown an apparatus for containing cremation ashes and displaying a photograph. The apparatus can be used to provide emotional support and sentimental value to a user who has lost loved ones.

What is claimed is:

1. An apparatus for containing cremation ashes and displaying a photograph, comprising:

a base having an interior side, an exterior side, and an outer ridge on the interior side of the base, the outer ridge allowing the base to accept and contain the cremation ashes and the photograph;

a cover with an interior side, an exterior side and a transparent face to view the ashes and the photograph;

a hinge mechanism for pivotally attaching the base and the cover;

a clasping mechanism for holding the cover in place with the base, comprising an appendage extending perpendicular from the interior of the cover and a knobby extension extending perpendicular from the appendage and parallel to the cover, the outer ridge of the base comprises an aperture fit to receive the appendage and the knobby extension whereby the cover remains fixed to the base;

a safety device to ensure that the cover remains in a closed position with respect to the base, wherein the base has a first internal threaded bore extending from the exterior side of the base through the outer ridge and through to the interior side of the base, the cover has a second internal bore extending from the interior of the cover to a point between the interior and exterior of the cover, and the safety device further comprises a screw extending through the first bore and into the second bore.

* * * * *